US009437954B2

(12) United States Patent
Marshall et al.

(10) Patent No.: US 9,437,954 B2
(45) Date of Patent: Sep. 6, 2016

(54) SERIES CONNECTOR

(71) Applicant: Interconnect Devices, Inc., Kansas City, KS (US)

(72) Inventors: Timothy E. Marshall, Lenexa, KS (US); David W. Henry, Platte City, MO (US); Donald A. Marx, Olathe, KS (US)

(73) Assignee: Interconnect Devices, Inc., Kansas City, KS (US)

( * ) Notice: Subject to any disclaimer, the term of this patent is extended or adjusted under 35 U.S.C. 154(b) by 0 days.

(21) Appl. No.: 13/871,955

(22) Filed: Apr. 26, 2013

(65) Prior Publication Data

US 2014/0322988 A1 Oct. 30, 2014

(51) Int. Cl.

| | |
|---|---|
| ***H01R 13/514*** | (2006.01) |
| *H01R 12/71* | (2011.01) |
| *H01R 13/24* | (2006.01) |

(52) U.S. Cl.

CPC ..... *H01R 13/514* (2013.01); *H01R 12/716* (2013.01); *H01R 13/2421* (2013.01)

(58) Field of Classification Search

USPC ..... 439/700, 717, 701, 415; 429/178, 463

See application file for complete search history.

(56) References Cited

U.S. PATENT DOCUMENTS

| | | | | |
|---|---|---|---|---|
| 3,042,895 | A * | 7/1962 | Bonhomme | 439/701 |
| 3,682,705 | A * | 8/1972 | Petix | 29/463 |
| 3,771,104 | A * | 11/1973 | Clark | 439/415 |
| 4,265,984 | A * | 5/1981 | Kaye | 429/178 |
| 4,611,879 | A * | 9/1986 | Bullard | 439/717 |
| 4,744,780 | A * | 5/1988 | Volpe | 446/128 |
| 5,295,870 | A * | 3/1994 | Rei et al. | 439/717 |
| 6,059,631 | A * | 5/2000 | Maddock | 446/127 |
| 6,413,119 | B1 * | 7/2002 | Gabrisko et al. | 439/620.1 |
| 6,793,534 | B2 * | 9/2004 | Cheng et al. | 439/620.04 |
| 7,095,628 | B2 * | 8/2006 | Friedrich et al. | 361/833 |
| 7,247,045 | B1 * | 7/2007 | Arellano | 439/416 |
| 7,361,055 | B2 * | 4/2008 | Fuerst | 439/620.09 |
| 7,413,481 | B2 * | 8/2008 | Redmond et al. | 439/717 |
| 7,815,474 | B1 | 10/2010 | Lin et al. | |
| 7,838,145 | B2 * | 11/2010 | Ratte et al. | 429/178 |
| 7,907,423 | B2 * | 3/2011 | Lopes et al. | 361/822 |
| 7,959,457 | B2 * | 6/2011 | Li et al. | 439/500 |
| 7,967,646 | B2 * | 6/2011 | De Carolis et al. | 439/717 |
| 8,079,195 | B2 * | 12/2011 | Cables | 52/572 |
| 8,182,288 | B1 | 5/2012 | Lin | |
| 2004/0110409 | A1 * | 6/2004 | Scarpellini et al. | 439/374 |
| 2006/0110978 | A1 * | 5/2006 | Fan et al. | 439/607 |
| 2009/0023347 | A1 | 1/2009 | Hou et al. | |
| 2010/0105239 | A1 * | 4/2010 | Li et al. | 439/366 |

FOREIGN PATENT DOCUMENTS

| | | |
|---|---|---|
| JP | 2006-216246 | 8/2006 |
| KR | 10-2010-0036992 | 4/2010 |

* cited by examiner

*Primary Examiner* — Alexander Gilman
(74) *Attorney, Agent, or Firm* — Snell & Wilmer LLP

(57) ABSTRACT

A configurable and modular probe device for electrical connections. The probe device has multiple blocks capable of inter-fitting into various layouts. Each block has four sidewalls. Two adjacent sidewalls have a protrusion and the respective opposite sidewalls have a cavity corresponding to the protrusion. The protrusion of one block can removably mate with the cavity of a neighboring block. Each block further has a central cavity extending from a top surface to a bottom surface of the block. A probe snugly fits into the central cavity.

17 Claims, 7 Drawing Sheets

SERIES CONNECTOR

BACKGROUND

1. Field

The present application relates generally to connector blocks for probes and improvements thereof. More particularly, the present application relates to inter-fitting blocks and improvements thereof.

2. Description of the Related Art

Electronic components, such as printed circuit boards (PCBs) and other electrical circuits are often manufactured discretely and subsequently electrically connected. For example, a PCB may require a connection to a battery. The PCB would have a set of probes for connecting to the electrical contacts of the battery. The probes may be spring probes to reduce damage to the PCB and the battery when the pressure is applied. The probes must be arranged to connect to the appropriate contact points on the PCB. A base can hold the probes in the appropriate layout. However, the base must be custom made for any given layout. This hard tooling may take 8-10 weeks or longer for the custom base to be made. Any change to the layout of the probes or contacts requires another mold of the base to be made, which may add significant time. In addition, the base cannot be further configurable, and consequently cannot be reusable for other layouts.

Therefore, a configurable and modular base for the probes is advantageous. A customizable base would ease the time to market, and a reusable base would further reduce costs.

SUMMARY

An apparatus for supporting probes in customizable layouts. In one implementation, a probe device used for electrical connections may include a block having a top surface, a bottom surface, a first sidewall, a second sidewall, a third sidewall, and a fourth sidewall and defining a central cavity therein. The first sidewall includes a first protrusion extending away from the central cavity, the second sidewall includes a second protrusion extending away from the central cavity, the third sidewall includes a first cavity directed towards the central cavity, and the fourth sidewall includes a second cavity directed towards the central cavity. The first sidewall is opposite the third sidewall and the second sidewall is opposite the fourth sidewall. A shape of the first protrusion corresponds to a shape of the first cavity and a shape of the second protrusion corresponds to a shape of the second cavity. The probe device further includes a probe configured to be snugly fit within the central cavity and extend beyond the top surface for electrical contact.

In another implementation, a probe device used for electrical connections includes a block having a top surface and a bottom surface and defining a central cavity extending from the top surface to the bottom surface. The block has a protrusion extending away from the central cavity on each of two adjacent sides and the block has a cavity extending towards the central cavity on each of two other adjacent sides such that each protrusion is opposite each cavity respectively. A shape of the protrusions corresponds to a shape of the cavities. The probe device further includes a probe configured to be snugly fit within the central cavity and extending beyond the top surface for electrical contact.

In another implementation, a probe device used for electrical connections includes a first block having a first top surface, a first bottom surface, and four sidewalls forming a rectangular shape and defining a first central cavity therein.

One of the four sidewalls includes a first protrusion extending away from the first central cavity. The first central cavity has a cylindrical opening. A second block has a second top surface, a second bottom surface, and four sidewalls forming the rectangular shape and defining a second central cavity therein. One of the four sidewalls includes a first cavity directed towards the second central cavity. The second central cavity has a cylindrical opening. The first protrusion of the first block is configured to removably mate with the first cavity of the second block. The probe device also includes a first probe having a cylindrical shape configured to be snugly fit within the first central cavity and extending beyond the first top surface for electrical contact, and a second probe having a cylindrical shape configured to be snugly fit within the second central cavity and extending beyond the second top surface for electrical contact.

BRIEF DESCRIPTION OF THE DRAWINGS

Other systems, methods, features, and advantages of the present application will be or will become apparent to one with skill in the art upon examination of the following figures and detailed description. It is intended that all such additional systems, methods, features, and advantages be included within this description, be within the scope of the present application, and be protected by the accompanying claims. Component parts shown in the drawings are not necessarily to scale, and may be exaggerated to better illustrate the important features of the present application. In the drawings, like reference numerals designate like parts throughout the different views, wherein:

DETAILED DESCRIPTION

Figure 1A:
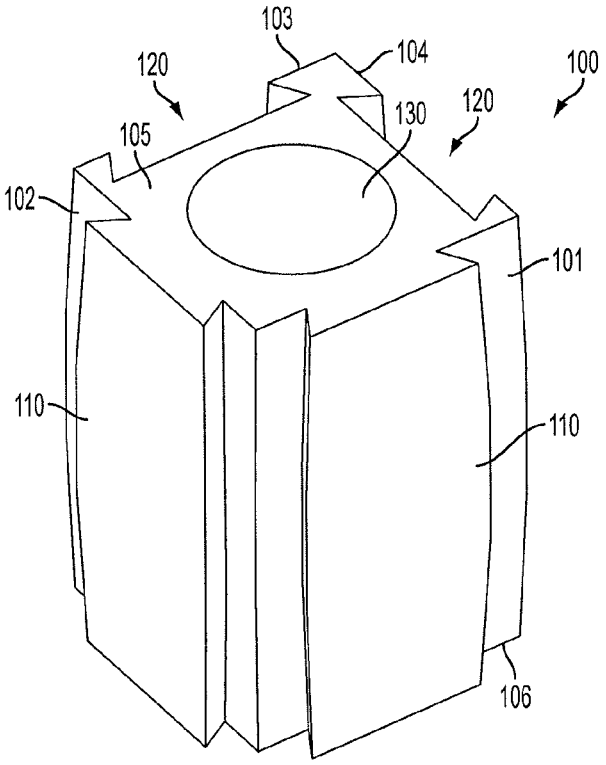
FIG. 1A is a perspective view of a single block according to an embodiment of the present disclosure.

FIG. 1A illustrates a block 100. The block 100 is rectangular in shape and has a first sidewall 101, a second sidewall 102, a third sidewall 103, and a fourth sidewall 104, which define an opening, a central cavity 130. The block 100 has a top surface 105 and a bottom surface 106, with the central cavity 130 extending from the top surface 105 to the bottom surface 106. The first sidewall 101 and the second sidewall 102 each has a protrusion extending away from the central cavity 130. As seen in FIG. 1A, the first sidewall 101 has a dovetail 110 and the second sidewall 102 has a dovetail 110. The dovetails 110 span a full height of the block 100, although in other implementations the protrusions may span a portion of the height. The third sidewall 103 and the fourth sidewall 104 each has a cavity directed towards the central cavity 130. The third sidewall 103 has a dovetail socket 120 as does the fourth sidewall 104. The cavities have a height corresponding to the height of the protrusions. The block 100 may be made from plastic or other suitable material. The block 100 can mate with other blocks 100 to create various grid patterns, as will be explained below.

Figure 1B:
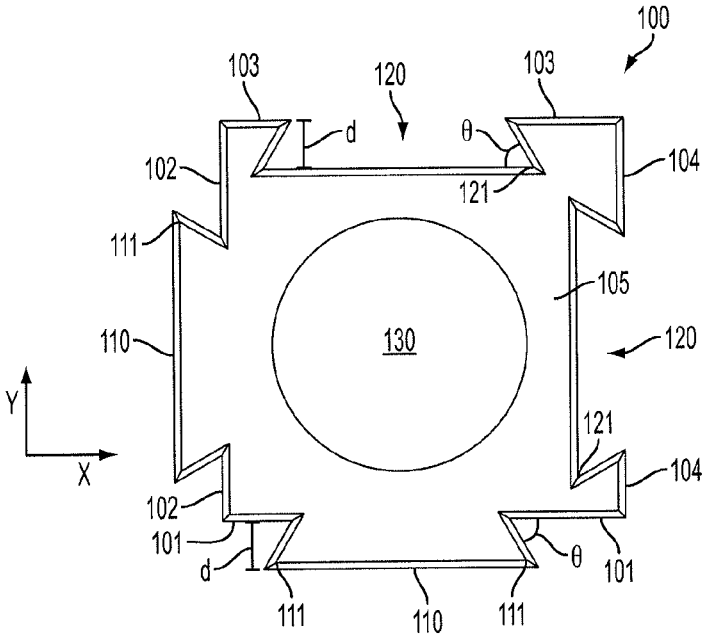
FIG. 1B is a top view of the block shown in FIG. 1A.

FIG. 1B shows a top-down view of the block 100 in FIG. 1A. The central cavity 130 is appropriately shaped to accept and house a probe, such as a probe 140 in FIGS. 1C-D. The probe 140 may have a cylindrically shaped probe shaft 145 with a 2.5 mm (0.100 in) center. The central cavity 130 has a corresponding circular shape to snugly fit a probe 140. In other implementations, the central cavity 130 may have a different shape to accommodate probes having different shaped shafts. In addition, certain blocks 100 may have different configurations for the central cavity 130. A block 100 may have no central cavity 130 in order to serve as a spacer. A block 100 may have a smaller or larger central cavity 130 to house a dowel pin. A block 100 may have a threaded central cavity 130 to accept screws.

The protrusions and cavities are shaped to mate with each other, by sliding a protrusion into a cavity or otherwise fitting the protrusion into the cavity. The first sidewall 101 has a dovetail 110. In FIG. 1B, the first sidewall 101 is depicted as two segments interrupted by a protruding dovetail 110. The dovetail 110 extends a suitable distance d away from the first sidewall 101. A dovetail corner 111 of the dovetail 110 flares out and forms an angle θ, which may be 45 degrees or any other suitable angle, such as 30 degrees or 60 degrees. Because the dovetail corners 111 flare out, the dovetail 110 cannot be laterally pulled out when slid into a dovetail socket 120.

The third sidewall 103, opposite the first sidewall 101, is depicted as two segments interrupted by a dovetail socket 120. The dovetail socket 120 has a shape corresponding to the dovetail 110. The dovetail socket 120 extends into the block 100 the distance d, and a dovetail socket corner 121 also forms the angle θ.

The second sidewall 102 has a dovetail 110, similar to the first sidewall 101. The fourth sidewall 104, which is opposite the second sidewall 102, has a dovetail socket 120, similar to the third sidewall 103. The corresponding shapes of the dovetails 110 and the dovetail sockets 120 allow for multiple blocks 100 to be inter-fitted. The dovetails 110 and dovetail sockets 120 are arranged such that a dovetail 110 is opposite a dovetail socket 120, leading to two adjoining sidewalls having a dovetail 110 each and the other two adjoining sidewalls having a dovetail socket 120 each. This arrangement allows the blocks 100 to be connected along the x-axis as well as the y-axis, as seen in FIG. 1B.

Because the blocks 100 can be added or removed as needed, the blocks 100 provide a configurable connector used for making electrical connections in a modular way. The blocks 100 also provide mechanical support, such as in applications requiring components to be connected multiple times as in plugging and unplugging the electrical connection. For example, a mobile device or smartphone may have a removable battery which can be connected and unconnected from the PCB multiple times. The block 100 also provides a scalable connector for electrical connections. With enough blocks 100, the probes 140 can be arranged for any type of electrical connection. The blocks 100 can be arranged to form a standard range of connectors, such as pin and socket connectors.

Figure 1C:
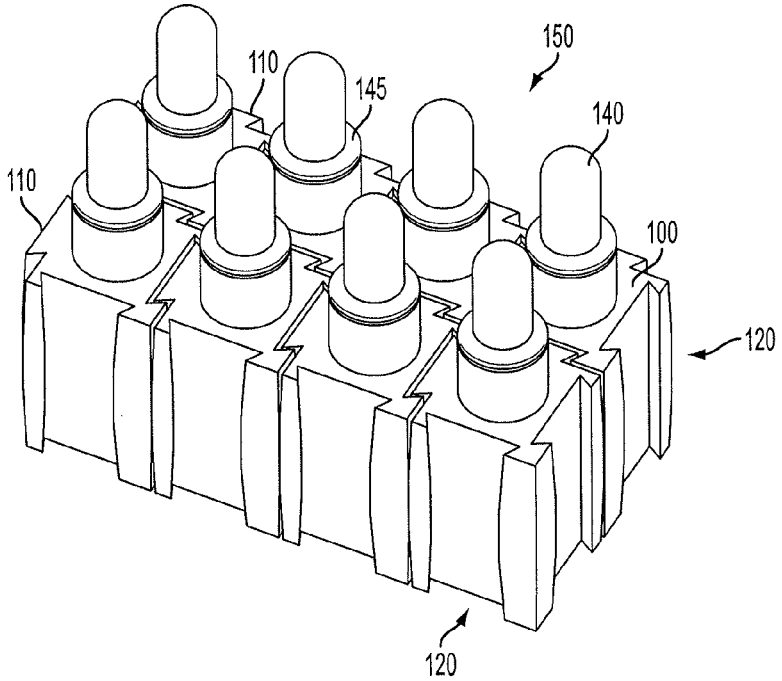
FIG. 1C is a perspective view of a plurality of blocks housing probes and arranged in a grid pattern according to an embodiment of the present disclosure.

FIG. 1C illustrates one possible layout using 8 blocks 100. The blocks 100 are connected in a 2×4 grid pattern to form a block assembly 150. This pattern may be suitable for a pin and socket connection. Each block 100 houses a probe 140, having a probe shaft 145. The probe 140 comprises an electrically conductive material with sufficient mechanical strength to be suitable as an electrical contact. The probe 140 may be a pogo-spring probe (or spring probe), or other probe used for electrical connections. Because spring probes can retract, they may not wear out as quickly. In other implementations, the probe 140 may comprise a solid piece of conductive material. The probe 140 may be a machined plug of metal or a pin. The probe shaft 145 is cylindrical, having a circular outline, which the central cavity 130 is configured to snugly fit. In other implementations the probe shaft 145 may have alternate shapes, such as the probe shaft 645 in FIG. 6B having a polygonal outline.

The dovetails 110 fit into the dovetail sockets 120 of neighboring blocks 100. The inter-fitting dovetails 110 and dovetail sockets 120 prevent the blocks 100 from separating, which helps maintain the desired layout. The arrangement of dovetails 110 and dovetail sockets 120 on each block 100 allows any number of blocks 100 to be connected together in either the x direction or y direction.

With all blocks 100 in a similar orientation, a block 100 can connect to any sidewall of another block 100. For a given block 100, its first sidewall 101 can connect to the third sidewall 103 of another block 100, the second sidewall 102 can connect to the fourth sidewall 104 of another block 100, the third sidewall 103 can connect to the first sidewall 101 of another block 100, and the fourth sidewall 104 can connect to the second sidewall 102 of another block 100. In other words, the dovetail 110 of the first sidewall 101 corresponds to the dovetail socket 120 of third sidewall 103 as well as the dovetail socket 120 of the third sidewalls 103 of other blocks 100, all blocks 100 being similar. This implementation of block 100 prefers all blocks 100 to be oriented the same way to ensure the grid pattern.

In other implementations, each sidewall may include both a protrusion and a matching cavity, such that any sidewall can connect to any neighboring block's sidewall regardless of the block's orientation. For example, if each sidewall has a dovetail and a dovetail socket, then the orientation of the blocks would not matter, while still allowing for custom layouts.

Figure 1D:
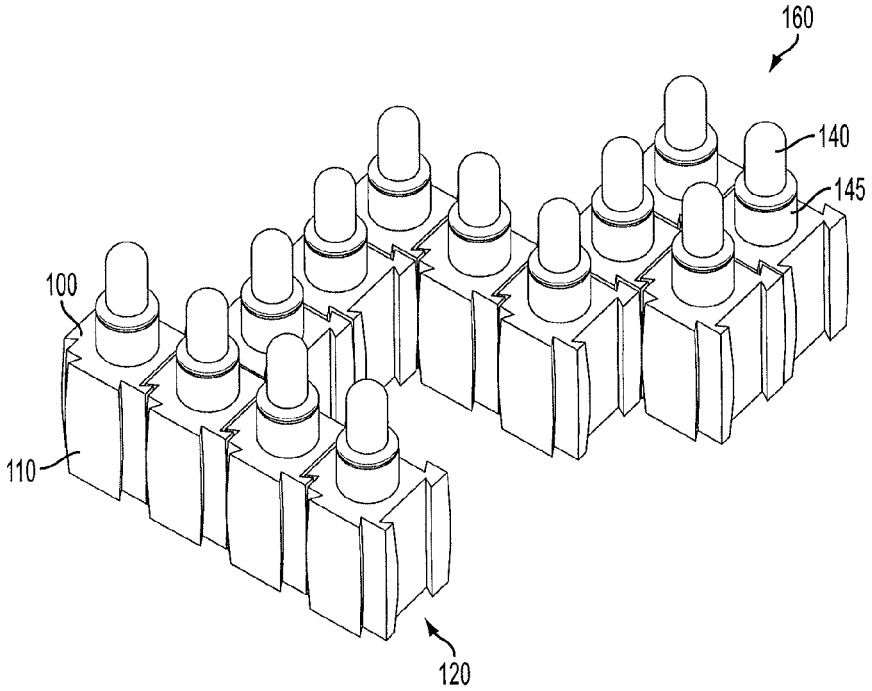
FIG. 1D is a perspective view of a plurality of blocks housing probes and arranged in customized layout according to an embodiment of the present disclosure.

FIG. 1D illustrates a block assembly 160, another possible configuration. As seen in FIG. 1D, the blocks 100 can be arranged in any x and y pattern. The symmetrical shape of the blocks 100, and the ability to connect on all four sidewalls allows the formation of various grid patterns, such as the block assembly 160.

Figure 2A:
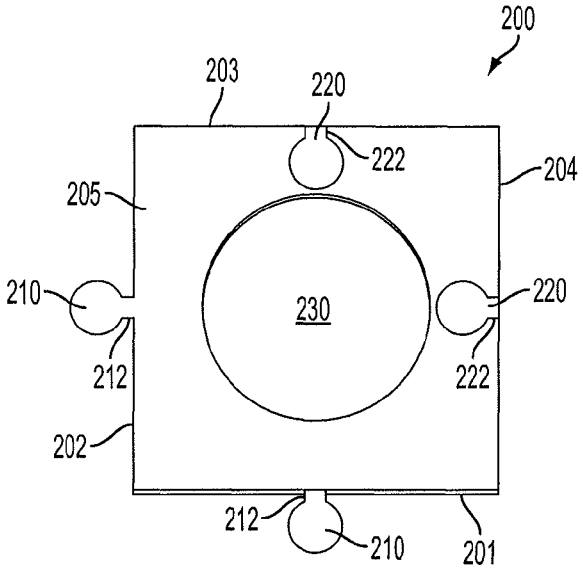
FIG. 2A is a top view of a single block with a hooking method different from the block of FIGS. 1A-D according to an embodiment of the present disclosure.

Turning to FIG. 2A, FIG. 2A illustrates a top-down view of a block 200 having a different shape for the protrusion and cavity. Block 200 has a first sidewall 201, a second sidewall 202, a third sidewall 203, and a fourth sidewall 204, which define an opening, central cavity 230, to house a probe. The central cavity 230 extends from a top surface 205 to a bottom surface 206 (not visible in FIG. 2A). The first sidewall 201 has a protrusion, tongue 210, which corresponds to a cavity, groove 220, in the third sidewall 203, opposite the first sidewall 201. Similarly, the second sidewall 202 has a tongue 210, which corresponds to a groove 220 in the fourth sidewall 204, opposite the second sidewall 202. Similar to the block 100 in FIG. 1A, the block 200 has complementary opposite sidewalls.

The protrusion and cavity have different shapes than those of block 100, but similarly function as a connector. The tongue 210 has a thinner portion at a tongue neck 212. The groove 220 has a groove neck 222, corresponding to the tongue neck 212. When the tongue 210 is fit into the groove 220, the tongue 210 is caught by the groove neck 222, preventing the tongue 210 from being laterally pulled apart.

Figure 2B:
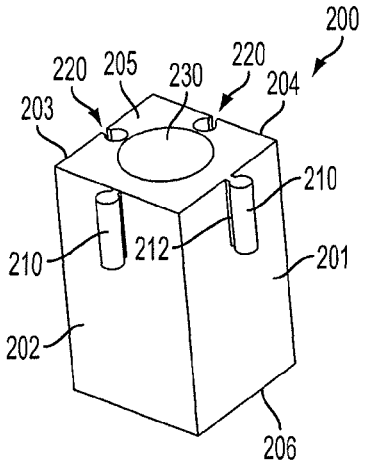
FIG. 2B is a perspective view of the protrusions of the block shown in FIG. 2A.
Figure 2C:
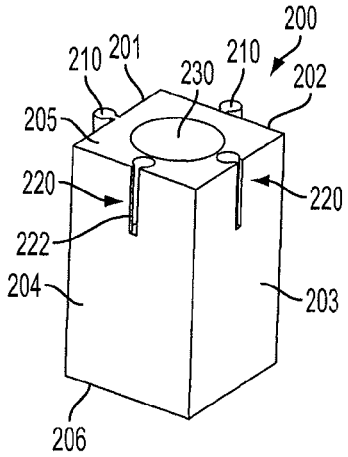
FIG. 2C is a perspective view of the cavities of the block shown in FIG. 2A.

FIGS. 2B and 2C show alternate views of the block 200. In certain implementations, the interlocking piece does not extend the full length of the block. Tongue 210 and groove 220 partially extend from the top surface 205 towards the bottom surface 206. The tongue 210 and the groove 220 may extend approximately ⅓, ¼, ½, ⅔, or ¾, or any other suitable portion of the block 200. In other implementations, the tongue 210 and the groove 220 may extend partially or fully from the bottom surface 206 towards the top surface 205. Similar to the block 100, multiple blocks 200 can be interconnected into any desired grid pattern.

Figure 3A:
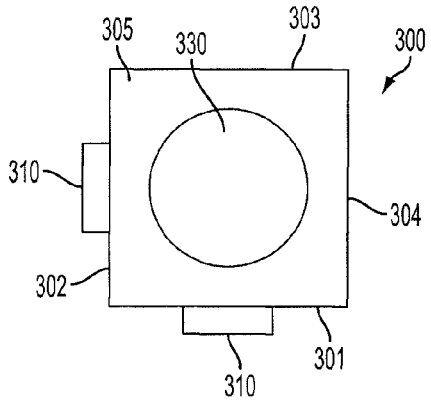
FIG. 3A is a top view of a single block with a hooking method different from the blocks shown in FIGS. 1A-D and 2A-C according to an embodiment of the present disclosure.
Figure 3B:
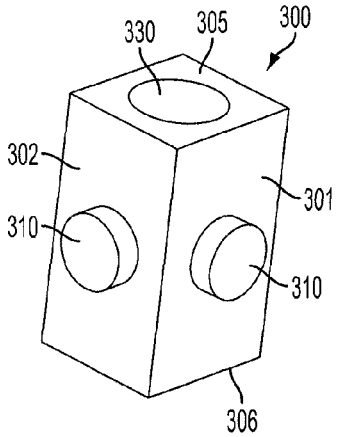
FIG. 3B is a perspective view of the protrusions of the block shown in FIG. 3A.

FIG. 3A illustrates a top-down view of another implementation of a block 300, having a different interacting feature. The block 300 has a first sidewall 301, a second sidewall 302, a third sidewall 303, and a fourth sidewall 304, which define a central cavity 330 that extends from a top surface 305 to a bottom surface 306 (not shown in FIG. 3A). The block 300 uses a mortise and tenon joint rather than the dovetail joint of block 100. In FIG. 3A, the first sidewall 301 and the second sidewall 302 each has a tenon 310. FIG. 3B presents an alternate view of the block 300, illustrating the tenons 310 as having a circular or cylindrical shape. In other implementations, the tenon 310 may take on any other appropriate shapes, such as square or rectangular. The tenons 310 are generally placed centrally on the first sidewall 301 and the second sidewall 302 but may be placed elsewhere on the sidewall in other implementations.

Figure 3C:
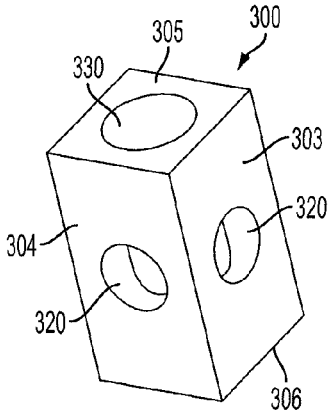
FIG. 3C is a perspective view of the cavities of the block shown in FIG. 3A.
Figure 3D:
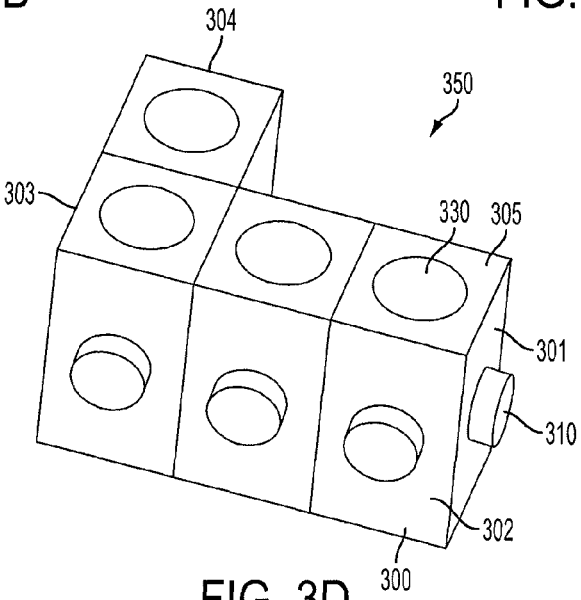
FIG. 3D is a perspective view of a plurality of blocks shown in FIG. 3A in a simple arrangement.

As seen in FIG. 3C, the third sidewall 303 and the fourth sidewall 304 each have a mortise 320. The mortise 320 has a shape and location corresponding to the tenon 310. The tenon 310 snugly fits in the mortise 320 to interconnect blocks 300. The blocks 300 can be arranged in any grid pattern. FIG. 3D depicts a block assembly 350.

The blocks 100, 200, and 300 generally have a rectangular shape, and are configured to inter-fit multiple iterations of the same block design. In other implementations, the probe connectors may take on different shapes. For example, the blocks 100, 200, or 300 may have 3, 5, 6, 7, 8, 9, 10 or any number of appropriate sides.

Figure 4A:
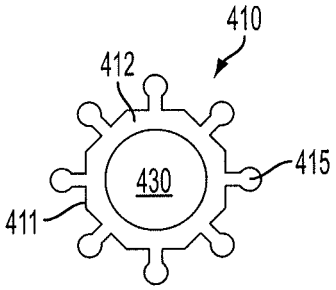
FIG. 4A is a top view of a block having protrusions according to an embodiment of the present disclosure.
Figure 4B:
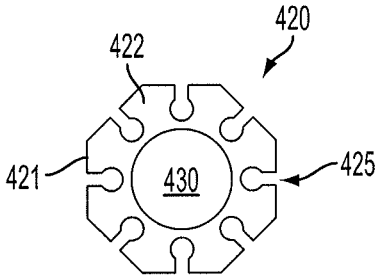
FIG. 4B is a top view of a block having cavities which mate with the protrusions of the block shown in FIG. 4A.

FIGS. 4A and 4B show two different types of blocks; a male block and a female block designed to inter-fit each other. FIG. 4A depicts a tongue block 410 (the male block) having eight sidewalls 411 which define a central cavity 430, which extends from a top surface 412 to a bottom surface 413 (not shown in FIG. 4A). The sidewalls 411 are equal and symmetrical such that the block 410 has a generally octagonal shape. Each sidewall 411 has a tongue 415 extending away from the central cavity 430. The number of interlocking features determines the number of directions the blocks can be mated. The tongue block 410 can be mated in eight directions, although other implementations may have more or fewer interlocking features.

FIG. 4B shows a complementary groove block 420 (the female block). The groove block 420 has eight sidewalls 421, which define a central cavity 430 that extends from a top surface 422 to a bottom surface 423 (not shown in FIG. 4B). The central cavity 430 is the same size and shape as the central cavity in FIG. 4A, such that the block 410 and the block 420 can house probes of similar shapes and sizes. The block 420 has eight equal sidewalls 421 forming an octagonal shape. Each sidewall 421 has a groove 425. The groove block 420 has the same number of grooves 425 as the number of tongues 415 in the block 410. Thus, the groove block 420 can also mate in eight directions. In other implementations, the groove block 420 can have more or fewer interlocking features, and may have a different amount than the tongue block 410.

Figure 4C:
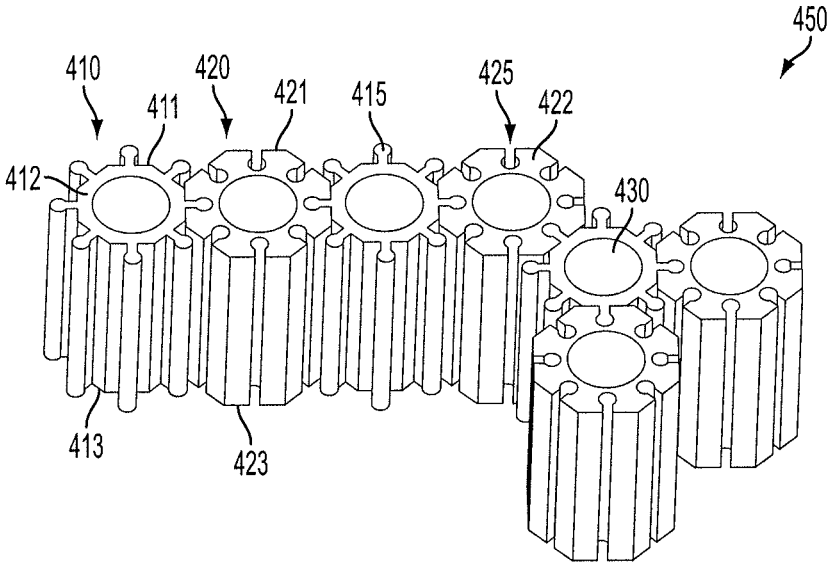
FIG. 4C is a view of a plurality of blocks shown in FIGS. 4A-B in a simple arrangement.

The tongue block 410 and the groove block 420 can be connected in an alternating fashion to form various layouts. Because the tongue block 410 and the groove block 420 can mate in eight directions, rather than four directions as with blocks 100, 200, or 300, a block assembly 450, in FIG. 4C, is not limited to a strict grid pattern. As seen in FIG. 4C, the tongue blocks 410 and the groove blocks 420 can branch out diagonally.

Figure 5A:
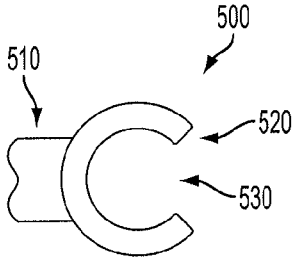
FIG. 5A is a top view of a connector according to an embodiment of the present disclosure.

Alternate plastic configurations may allow different spacing than other connectors, which is advantageous for different electrical requirements such as radio frequency (RF), dielectric, shielding, PCB path routings, etc. The probe connectors may take on other shapes, such as a connector 500 in FIG. 5A having a C shape. The connector 500 has a hook 520 that defines an opening 530. The hook 520 and the opening 530 are configured to snugly fit around a probe shaft 545 of a probe 540 (shown in FIG. 5C).

Figure 5B:
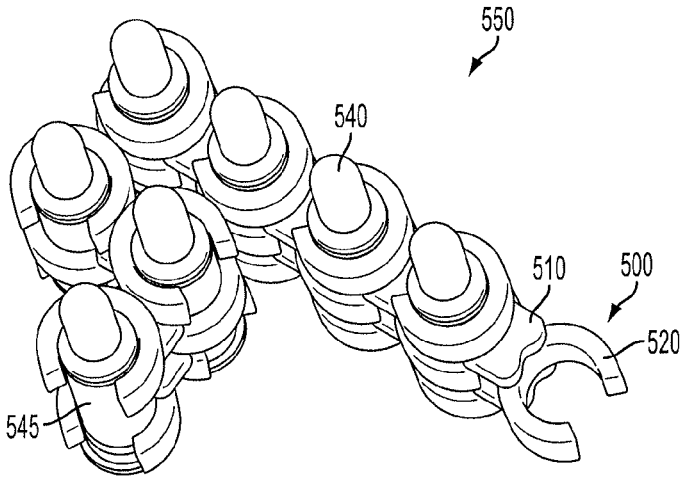
FIG. 5B is a perspective view of a plurality of connectors in a grid-like arrangement according to an embodiment of the present disclosure.
Figure 5C:
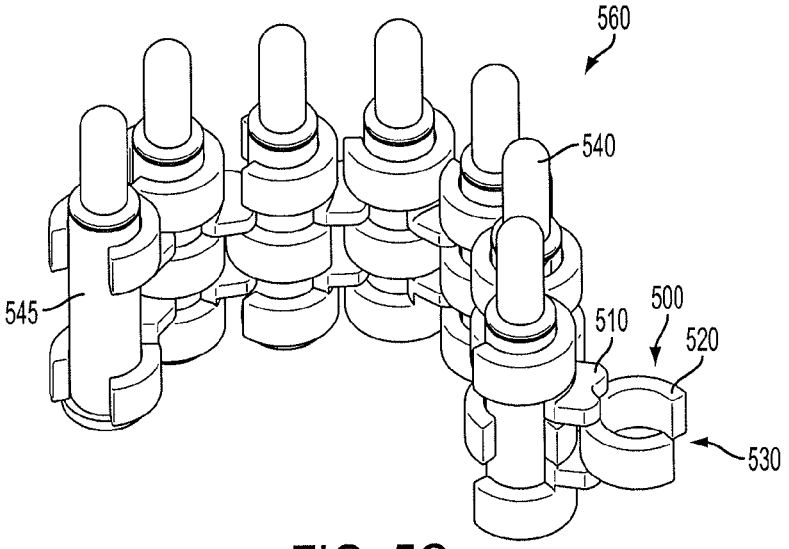
FIG. 5C is a view of a plurality of connectors shown in FIGS. 5A-B in a curved arrangement.

The connector 500 also includes a movement limiter 510, which allows an even spacing to be maintained between probes 540, as seen in FIG. 5B. Each connector 500 has a height less than that of the probe shaft 545 such that multiple connectors 500 may attach to a single probe shaft 545 to provide adequate support as well as provide connection points for neighboring probes 540 and connectors 500. In addition, the movement limiter 510 may limit the probes to specific orientations, or a limited range of orientations. Assembly 550 in FIG. 5B illustrates a grid pattern when the movement limiter 510 restricts the connectors 500 to 90 degree orientations, i.e. 0 degrees, 90 degrees, 180 degrees, 270 degrees. However, the movement limiter 510 can be configured to allow a range of angles between each set of probes 540. The ranges may be narrow, such as 0 to 60 degrees or 0 to 30 degrees, or may be broad, such as 0 to 180 degrees or 0 to 360 degrees. In FIG. 5C, an assembly 560 has a curved layout when the movement limiters 510 are configured to allow any angle.

Figure 6A:
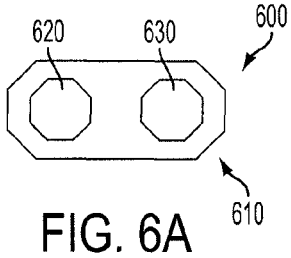
FIG. 6A is a top view of a double connector according to an embodiment of the present disclosure.

FIG. 6A depicts another implementation of a probe connector. Connector 600 has eight sides defining a first opening 620 and a second opening 630. The first opening 620 and the second opening 630 have an octagonal shape configured to snugly fit an octogonally shaped probe shaft holder 647 housing a probe shaft 645 of a probe 640. Although the first opening 620 and the second opening 630 have the same shape, in other implementations, the first opening 620 and the second opening 630 may have different shapes.

Figure 6B:
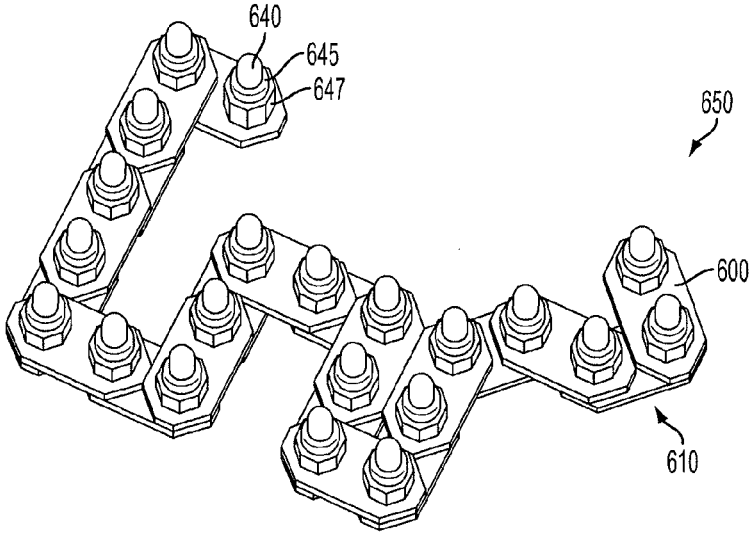
FIG. 6B is a perspective view of a plurality of double connectors according to an embodiment of the present disclosure.
Figure 6C:
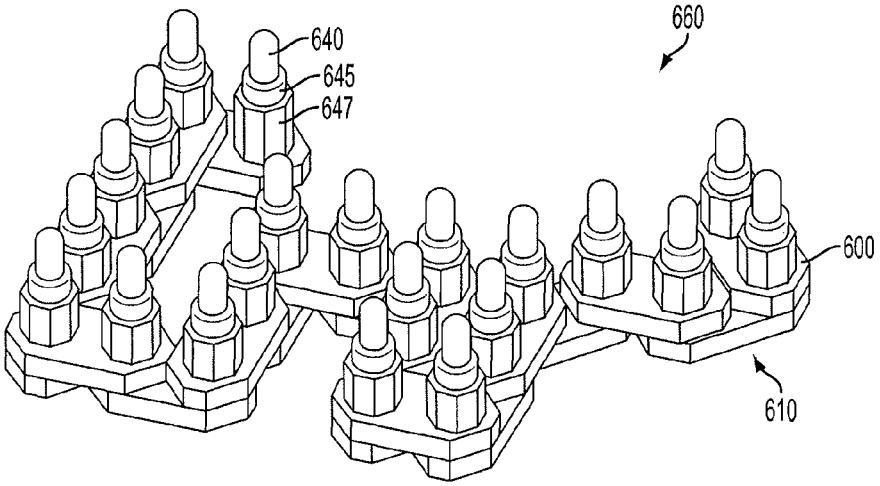
FIG. 6C is another perspective view of the plurality of double connectors shown in FIG. 6B.

In addition to the basic 90 degree orientations, a corner 610 allows for angled orientations. FIG. 6B depicts an assembly 650 and FIG. 6C depicts an assembly 660. As seen in FIGS. 6B and 6C, the corners 610 allow for 45 degree orientations, such as 45 degrees, 135 degrees, 225 degrees, and 315 degrees. Other implementations may allow for different angle orientations, such as 30 degrees (30 degrees, 120 degrees, 210 degrees, 300 degrees, etc.) or 60 degrees (60 degrees, 150 degrees, 240 degrees, 330 degrees, etc.).

Each connector 600 has a height less than that of the probe shaft holder 647. A single connector 600 can connect two probes 640. Using multiple connectors 600 on each probe shaft holder 647 allows a probe 640 to be connected to multiple other probes 640.

Exemplary implementations of the application have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such implementations that reasonably fall within the scope of the advancement to the art hereby contributed, and that that scope shall not be restricted, except in light of the appended claims and their equivalents.

What is claimed is:

1. A probe device for electrical connections, comprising:

a first block having a first top surface, a first bottom surface, and a first plurality of sidewalls defining a first central cavity therein, a first sidewall of the first plurality of sidewalls including a first protrusion that has a first shape and extends away from the first central cavity and a second sidewall of the first plurality of sidewalls including a first cavity that has a second shape that corresponds to the first shape and is directed towards the first central cavity;

a second block having a second top surface, a second bottom surface, and a second plurality of sidewalls defining a second central cavity therein, a first sidewall of the second plurality of sidewalls including a first cavity that has the second shape and is directed towards the second central cavity of the second block such that the first protrusion of the first block is configured to removably mate with the first cavity of the second block;

a first probe having a first probe shaft that is configured to fit within the first central cavity and to extend through the first central cavity from the first bottom surface to the first top surface, and having a first probe contact portion extending beyond the first probe shaft away from the first top surface, the first probe providing a first electrical contact between a first device and a second device that is different from the first device; and a second probe electrically insulated from the first probe and having a second probe shaft that is configured to fit within the second central cavity and to extend through the second central cavity from the second bottom surface to the second top surface, and having a second probe contact portion extending beyond the second probe shaft away from the second top surface, the second probe providing a second electrical contact between the first device and the second device, wherein the first block and the second block are each configured to removably mate with at least one additional block in order to provide a custom connection layout that can be asymmetrical for electrically connecting the first device and the second device.

2. The probe device of claim 1, wherein a third sidewall of the first plurality of sidewalls includes a second protrusion that has the first shape and extends away from the first central cavity, and a fourth sidewall of the first plurality of sidewalls is opposite the third sidewall and includes a second cavity that has the second shape and is directed towards the first central cavity.

3. The probe device of claim 1, wherein the first protrusion is opposite the first cavity.

4. The probe device of claim 1, wherein the first sidewall is adjacent the second sidewall.

5. The probe device of claim 1, wherein the first protrusion has a dovetail shape, and the first cavity has a dovetail socket shape.

6. The probe device of claim 1, wherein the first block and the second block are configured to position the first probe and the second probe such that the first probe and the second probe electrically connect the first device and the second device without a surrounding housing.

7. A probe device used for electrical connections, comprising:

a block having a top surface and a bottom surface and defining a central cavity extending from the top surface to the bottom surface, the block having a protrusion extending away from the central cavity on each of two adjacent sides, the block having a cavity extending towards the central cavity on each of two other adjacent sides such that each protrusion is opposite each cavity respectively, and a shape of the protrusions corresponding to a shape of the cavities such that the probe device can be connected with additional probe devices in order to provide a custom connection layout that can be asymmetrical for electrically connecting two devices; and a probe having a probe shaft that is configured to fit within the central cavity and to extend through the central cavity from the bottom surface to the top surface, and having a probe contact portion extending beyond the top surface, the probe establishing an electrical contact between a first device and a second device that is different from the first device.

8. The probe device of claim 7, wherein the protrusion comprises a tongue.

9. The probe device of claim 7, wherein the protrusion comprises a tenon and the cavity comprises a mortise.

10. The probe device of claim 9, wherein the tenon has a cylindrical shape.

11. The probe device of claim 7, wherein the protrusion is centrally located with respect to the corresponding side of the block.

12. A modular probe device for electrical connections, comprising:

a first block having a first top surface, a first bottom surface, and a first plurality of sidewalls defining a first central cavity therein, one of the first plurality of sidewalls including a first protrusion extending away from the first central cavity;

a second block having a second top surface, a second bottom surface, and a second plurality of sidewalls defining a second central cavity therein, one of the second plurality of sidewalls including a first cavity directed towards the second central cavity, the first protrusion of the first block configured to removably mate with the first cavity of the second block;

a first probe having a first probe shaft that is configured to fit within the first central cavity and to extend through the first central cavity from the first bottom surface to the first top surface, and having a first probe contact portion extending beyond the first top surface, the first probe providing a first electrical contact between a first device and a second device that is different from the first device; and a second probe electrically insulated from the first probe, having a second probe shaft that is configured to fit within the second central cavity and to extend through the second central cavity from the second bottom surface to the second top surface, and having a second probe contact portion extending beyond the second top surface, the second probe providing a second electrical contact between the first device and the second device, wherein the first block and the second block are each configured to removably mate with at least one additional block in order to provide a custom connection layout that can be asymmetrical for electrically connecting the first device and the second device.

13. The modular probe device of claim 12, wherein a sidewall of the first block opposite the first protrusion further includes a second cavity.

14. The modular probe device of claim 13, wherein a sidewall of the second block opposite the first cavity further includes a second protrusion.

15. The modular probe device of claim 12, wherein the first protrusion has a dovetail shape and the first cavity has a dovetail socket shape.

16. The modular probe device of claim 12, wherein the first protrusion has a tongue shape and the first cavity has a groove shape.

17. The modular probe device of claim 12, wherein the first protrusion has a tenon shape and the first cavity has a mortise shape.

* * * * *